US010934822B2

(12) United States Patent
Chalifoux

(10) Patent No.: US 10,934,822 B2
(45) Date of Patent: Mar. 2, 2021

(54) LOW-PRESSURE METHOD AND APPARATUS OF PRODUCING HYDROCARBONS FROM AN UNDERGROUND FORMATION USING ELECTRIC RESISTIVE HEATING AND SOLVENT INJECTION

(71) Applicant: PETROSPEC ENGINEERING INC., Sherwood Park (CA)

(72) Inventor: Gerald V. Chalifoux, Sherwood Park (CA)

(73) Assignee: Petrospec Engineering Inc., Sherwood Park (CA)

( * ) Notice: Subject to any disclaimer, the term of this patent is extended or adjusted under 35 U.S.C. 154(b) by 387 days.

(21) Appl. No.: 15/078,917

(22) Filed: Mar. 23, 2016

(65) Prior Publication Data

US 2017/0275979 A1 Sep. 28, 2017

(51) Int. Cl.

| | |
|---|---|
| ***E21B 43/24*** | (2006.01) |
| ***E21B 43/16*** | (2006.01) |
| ***E21B 43/30*** | (2006.01) |
| ***E21B 43/241*** | (2006.01) |

(52) U.S. Cl.

CPC ..... *E21B 43/2401* (2013.01); *E21B 43/168* (2013.01); *E21B 43/241* (2013.01); *E21B 43/305* (2013.01)

(58) Field of Classification Search

None

See application file for complete search history.

(56) References Cited

U.S. PATENT DOCUMENTS

| | | | | |
|---|---|---|---|---|
| 4,424,859 | A * | 1/1984 | Sims | E21B 17/06 166/187 |
| 4,886,118 | A * | 12/1989 | Van Meurs | E21B 36/04 166/245 |
| 5,141,054 | A | 4/1992 | Alameddine et al. | |
| 6,070,663 | A * | 6/2000 | Cernocky | E21B 43/14 166/242.2 |
| 7,156,176 | B2 | 1/2007 | Vinegar et al. | |

(Continued)

FOREIGN PATENT DOCUMENTS

| | | |
|---|---|---|
| CA | 2374115 | 5/2010 |
| CA | 2688937 | 6/2011 |

(Continued)

*Primary Examiner* — Andrew Sue-Ako

(74) *Attorney, Agent, or Firm* — Christensen O'Connor Johnson Kindness, PLLC

(57) ABSTRACT

A method of producing hydrocarbons from an underground formation having an array of horizontal wells has the steps of: inserting one or more heater strings into at least one heater well section, the heater string comprising a heating element and a flow passage for transporting fluid from a fluid input to at least one injection port; activating the heating element of the heater string to heat the formation sufficient to produce hydrocarbons from the formation immediately adjacent to the at least one heater well section; heating and injecting a solvent into the at least one heater well in the gaseous phase through the at least one injection port of the heater string such that the solvent is injected into the voidage in the at least one heater well section created by the produced hydrocarbons; and producing hydrocarbons from at least one producer well.

36 Claims, 6 Drawing Sheets

(56) References Cited

U.S. PATENT DOCUMENTS

| | | | | |
|---|---|---|---|---|
| 7,861,770 | B2 | 1/2011 | Milano et al. | |
| 7,938,904 | B1 * | 5/2011 | Wiggs | C04B 28/02 106/713 |
| 7,980,312 | B1 | 7/2011 | Hill et al. | |
| 8,011,438 | B2 | 9/2011 | Edwards et al. | |
| 2010/0108317 | A1 * | 5/2010 | Cimolai | E21B 43/24 166/272.3 |
| 2010/0258315 | A1 | 10/2010 | Lockhart et al. | |
| 2011/0094728 | A1 | 4/2011 | Sims | |
| 2011/0247810 | A1 * | 10/2011 | Ocampos | E21B 43/24 166/272.1 |
| 2011/0308806 | A9 | 12/2011 | Dykstra et al. | |
| 2011/0315375 | A1 | 12/2011 | Moscato et al. | |
| 2012/0234537 | A1 * | 9/2012 | Sultenfuss | E21B 43/2408 166/272.3 |
| 2013/0199780 | A1 * | 8/2013 | Scott | E21B 43/24 166/268 |
| 2013/0248177 | A1 * | 9/2013 | Kerr | C10G 1/002 166/272.3 |
| 2014/0054028 | A1 * | 2/2014 | Little | E21B 43/2401 166/248 |
| 2014/0190691 | A1 * | 7/2014 | Vinegar | B09C 1/02 166/272.1 |
| 2015/0096756 | A1 * | 4/2015 | Sharma | E21B 43/24 166/306 |
| 2017/0211367 | A1 * | 7/2017 | Trautman | E21B 43/305 |

FOREIGN PATENT DOCUMENTS

| | | |
|---|---|---|
| CA | 2633061 | 9/2012 |
| GB | 2384015 | 7/2003 |
| WO | 2011026226 A1 | 3/2011 |

* cited by examiner

LOW-PRESSURE METHOD AND APPARATUS OF PRODUCING HYDROCARBONS FROM AN UNDERGROUND FORMATION USING ELECTRIC RESISTIVE HEATING AND SOLVENT INJECTION

FIELD

This relates to a method of producing hydrocarbons from an underground formation.

BACKGROUND

Heavy oil is often produced using SAGD (steam assisted gravity drainage) processes. In SAGD, there is a preheating phase and a production phase. The preheating phase proceeds until the hydrocarbons are sufficiently warm to allow mobility. The process then moves to the production phase. Generally speaking, SAGD uses pairs of horizontal wells, where the top well is a steam injection well and the bottom well is a production well. Heat associated with the steam is applied to the top well to reduce the viscosity of the heavy oil, and hydrocarbons are recovered from the bottom well and pumped to surface.

SUMMARY

According to an aspect, there is provided a method of producing hydrocarbons from an underground formation having an array of horizontal wells, comprising the steps of: identifying one or more producer well sections and one or more heater well sections in the array of horizontal wells; inserting one or more heater strings into at least one heater well section, the heater string comprising a heating element and a flow passage for transporting fluid from a fluid input to at least one injection port; activating the heating element of the heater string to heat the formation sufficient to produce hydrocarbons from the formation immediately adjacent to the at least one heater well section; heating and injecting a solvent into the at least one heater well in the gaseous phase through the at least one injection port of the heater string such that the solvent is injected into the voidage in the at least one heater well section created by the produced hydrocarbons; and producing hydrocarbons from at least one producer well.

According to another aspect, the solvent may be injected into the formation prior to hydrocarbons being produced from the at least one producer well.

According to another aspect, the heater string may comprise a plurality of injection ports spaced along a length of the heater string. The plurality of injection ports may be scaled to distribute solvent in a desired distribution along a length of the heater string. A plurality of injection ports may be connected to separate injection tubes. The injection through each injection port may be independently controlled. An injection rate through each injection port may be selected to achieve a desired distribution of solvent.

According to another aspect, the heating element may be a resistive heater.

According to another aspect, the solvent may be injected into the heater string as a liquid and may be vapourized prior to injection into the voidage.

According to another aspect, the solvent may be injected into the heater string in a gaseous phase.

According to another aspect, the solvent may comprise a light hydrocarbon or a manufactured hydrocarbon compound.

According to another aspect, the solvent may comprise dimethyl ether.

According to another aspect, the method may further comprise the step of injecting a carrier gas after injecting the solvent to promote the production of hydrocarbons, and the carrier gas may comprise a carbon-containing gas, an inert gas, or a carbon-containing gas and an inert gas.

According to another aspect, the method may further comprise the steps of identifying locations within the underground formation that require additional heating, and providing one or more heater wells in one or more identified locations, wherein providing a heater well comprises the steps of drilling a heater well borehole in the one or more identified locations using a drill string, the heater well borehole comprising an entry portion drilled at an angle of less than 90 degrees to a ground surface, an exit portion extending to the ground surface, and a horizontal portion connecting the entry portion and the exit portion, attaching an elongate supplemental heater to the drill string at the exit portion, withdrawing the drill string from the heater well borehole such that the elongate supplemental heater is disposed within at least a portion of the heater well borehole, detaching the elongate supplemental heater from the drill string, and filling the heater well passage with a filling material that surrounds the supplemental heater.

According to another aspect, the filling material may comprise cement.

According to another aspect, the cement may further comprise an additive that increases the thermal conductivity of the cement.

According to another aspect, the additive may comprise metal filings.

According to another aspect, the elongate supplemental heater may comprise an electric heating element that may be connected at a first end to a positive side of a power supply and at a second end to a negative side of the power supply.

According to another aspect, providing one or more heater wells may comprise providing a plurality of heater wells, the supplemental heaters of each of the heater wells being connected to a common power supply.

According to an aspect, there is provided a method of producing hydrocarbons from an underground formation having an array of horizontal wells spaced vertically and laterally in the underground formation, the method comprising the steps of: identifying an upper group of well sections and a lower group of well sections, the upper group of well sections being positioned above the lower group of well sections; inserting heating elements into the upper and lower groups of well sections, the heating elements in at least the upper groups of well sections comprising a flow passage for communicating fluid from a fluid input to at least one injection port; creating voidage in the formation immediately adjacent to the upper and lower groups of well sections by applying sufficient heat to mobilize a portion of the hydrocarbons and producing the mobilized hydrocarbons; once voidage is created, injecting heated gaseous solvent into the voidage of the upper group of well sections; and producing hydrocarbons from the lower group of well sections.

According to another aspect, the method may further comprise the steps of: identifying a third group of well sections above the upper group of well sections; and once voidage is created, moving the heating elements from the lower groups of well sections to the third group of well sections.

According to an aspect, the solvent may be injected into the formation prior to hydrocarbons being produced from the at least one producer well.

According to another aspect, the heater string may comprise a plurality of injection ports spaced along a length of the heater string.

According to another aspect, the heating element may be a resistive heater.

According to another aspect, the solvent may be injected into the heater string as a liquid and is vapourized prior to injection into the voidage, or may be injected into the heater string in a gaseous phase.

According to another aspect, each injection port may be connected to an injection tube. The injection through each injection port may be independently controlled. An injection rate through each injection port may be selected to achieve a desired distribution of solvent.

According to another aspect, the solvent may comprise a light hydrocarbon or a manufactured hydrocarbon compound.

According to another aspect, the solvent may comprise dimethyl ether.

According to another aspect, the method may further comprise the step of injecting a carrier gas after injecting the solvent to promote the production of hydrocarbons, and the carrier gas may comprise a carbon-containing gas, an inert gas, or a combination of a carbon-containing gas and an inert gas.

According to another aspect, the method may further comprise the steps of identifying locations within the underground formation that require additional heating, and providing one or more heater wells in one or more identified locations, wherein providing a heater well comprises the steps of drilling a heater well borehole in the one or more identified locations using a drill string, the heater well borehole comprising an entry portion drilled at an angle of less than 90 degrees to a ground surface, an exit portion extending to the ground surface, and a horizontal portion connecting the entry portion and the exit portion, attaching an elongate supplemental heater to the drill string at the exit portion, withdrawing the drill string from the heater well borehole such that the elongate supplemental heater is disposed within at least a portion of the heater well borehole, detaching the elongate supplemental heater from the drill string, and filling the heater well passage with a filling material that surrounds the supplemental heater.

According to another aspect, the filling material may comprise cement.

According to another aspect, the cement may further comprise an additive that increases the thermal conductivity of the cement.

According to another aspect, the additive may comprise metal filings.

According to another aspect, the elongate supplemental heater may comprise an electric heating element that may be connected at a first end to a positive side of a power supply and at a second end to a negative side of the power supply.

According to another aspect, providing one or more heater wells may comprise providing a plurality of heater wells, the supplemental heaters of each of the heater wells being connected to a common power supply.

According to an aspect, there is provided an injector string installed in a well that extends down from surface, comprising a coiled tubing string having an inner bore, a downhole end and a formation section toward the downhole end. A source of solvent is connected to the inner bore of the coiled tubing string, the source of solvent injecting solvent along the inner bore toward the downhole end of the coiled tubing string. A series of injection ports are spaced longitudinally along the formation section of the coiled tubing string. A heating element is installed within the inner bore of the coiled tubing string extending along at least a portion of the formation section of the coiled tubing string and connected to a power source at surface, the heating element heating the solvent such that the solvent exits the series of ports as a heated vapour.

According to another aspect, the solvent may be a liquid or a gas when injected into the coiled tubing string.

According to another aspect, the series of injection ports may be scaled to distribute solvent in a desired distribution along a length of the heater string.

According to another aspect, a plurality of injection ports may be connected to separate injection tubes. There may be a controller that independently controls the solvent injection through each injection tube and injection port. The controller may comprise instructions to inject the solvent through each injection tube and injection port to achieve a desired distribution of solvent.

According to another aspect, the heating element may be a resistive heater.

According to another aspect, the solvent may be injected into the heater string as a liquid and vapourized prior to injection into the voidage.

According to another aspect, the solvent may be injected into the heater string in a gaseous phase.

According to another aspect, the solvent may comprise a light hydrocarbon or a manufactured hydrocarbon compound.

According to another aspect, the solvent may comprise dimethyl ether.

The above aspects and other aspects that will be apparent from the specification and drawings may be combined in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
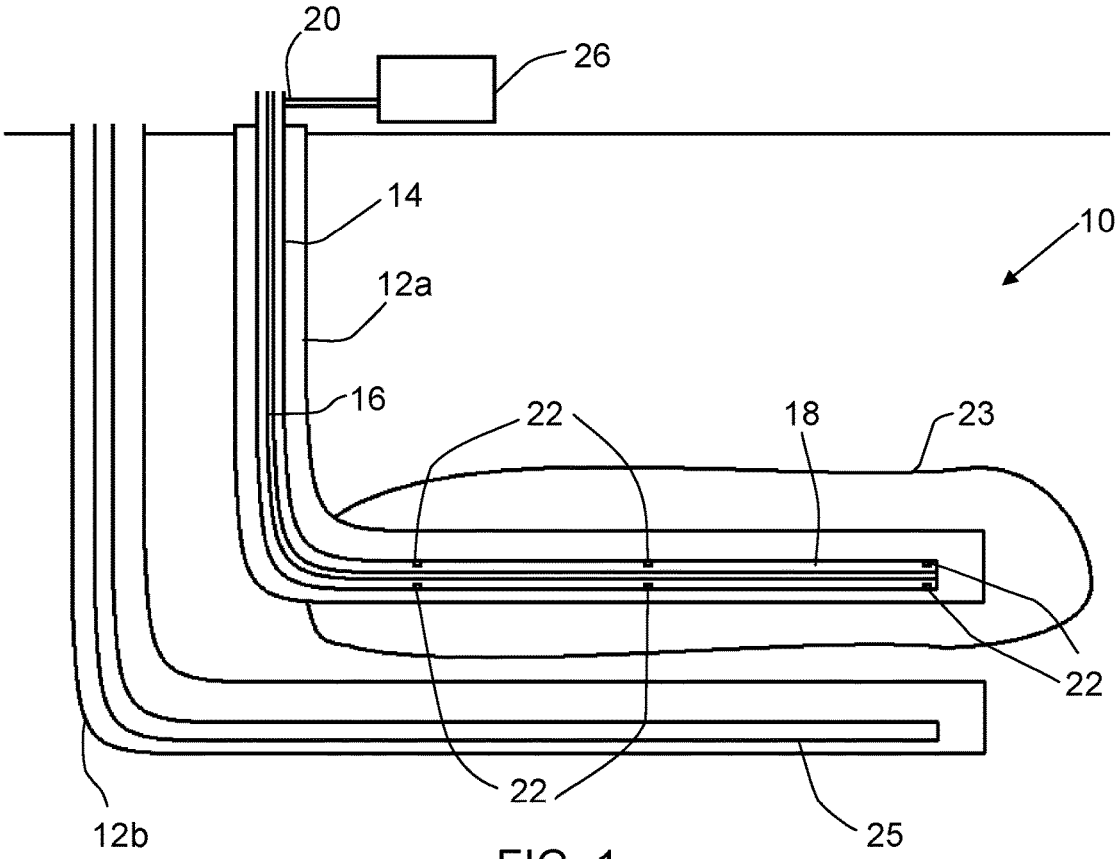
FIG. 1 is a schematic drawing of a well pair being heated by a heater string.

There will now be described a method of producing hydrocarbons from an underground formation having an array of horizontal wells. The underground formation is of a type that contains hydrocarbons, and is generally indicated by reference numeral 10 in FIG. 1. Generally speaking, a significant portion of the hydrocarbons will be heavy oil or other hydrocarbons that require one or more of heat, steam or solvents to be applied in order to enhance production, as will be recognized by those skilled in the art. In these types of reservoirs, SAGD and other types of thermal processes would normally be contemplated in order to produce the hydrocarbons. However, in some situations, SAGD would not be economical, or is rendered inoperable, such as when the maximum operating pressure is too low to achieve sufficient temperature with steam. Examples may include reservoirs that lack a competent cap rock, reservoirs that are in close proximity to quaternary channels, close proximity to outcrops or other geological unconformities or other reservoirs where pressure is too low to support sufficient steam temperature. The process described herein may be particularly useful in these types of situations. For example, SAGD operations typically operate at around 200° C. (1,550 kPa), or more commonly around 220° C. (2,320 kPa), but generally not less than 180° C. (1,000 kPa). The presently described process may operate below or much closer to static reservoir pressure, which may be between, for example, 100-800 kPa, which would correspond to a saturated steam temperature of between 100° C.-170° C. It will be further recognized that the method described herein is not specifically limited to these types of formations, and may be applied to other types of formation where heat, steam and/or solvents would normally be required to produce oil from the formation. As the present method also involves the injection of fluids in a gaseous state, its efficiency will also be reduced by a low maximum operating pressure. With this apparatus, the injection of the gaseous fluids may still be effectively and uniformly distributed over the length of the heater via the plurality of ports spaced along the length of the heater. Further, this method and apparatus may present an alternative to surface mining methods for oil sands recovery.

Figure 3:
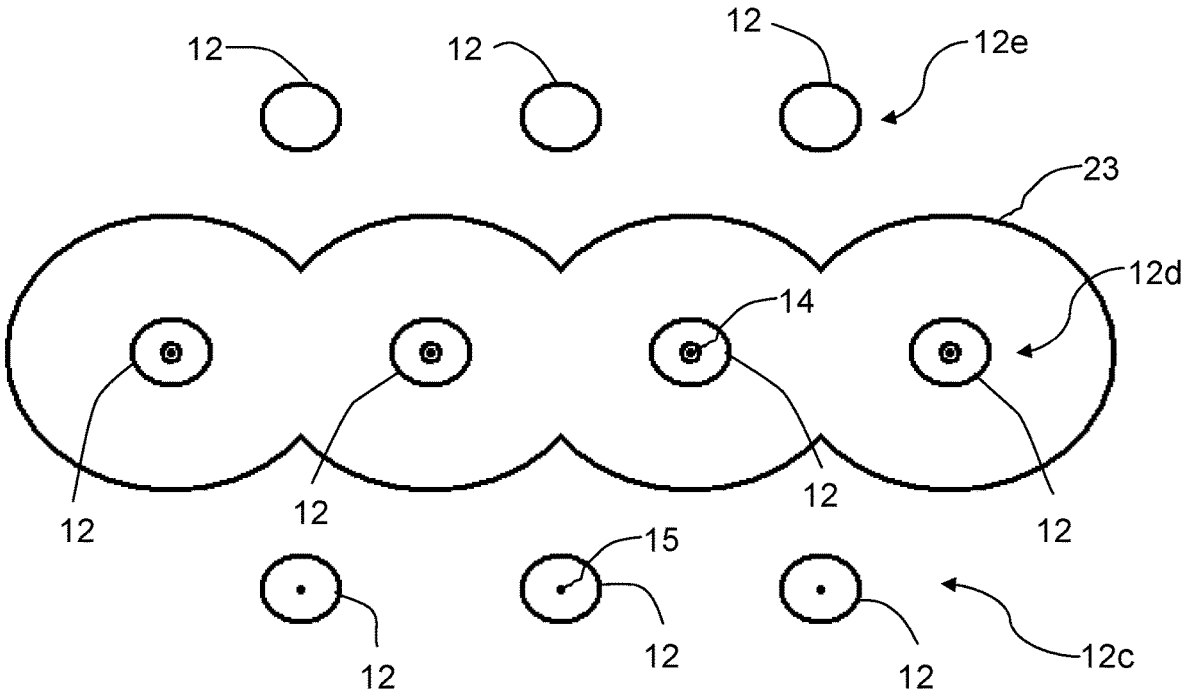
FIG. 3 is an end elevation view of a horizontal wellbore pattern in a formation being preheated.

An array of wells 12 is drilled in formation 10. FIG. 1 depicts a pair of wells 12, as is commonly used in SAGD operations, and this may be considered an array. In this type of arrangement, the lower well 12 is considered the producing well, and the upper well 12 is considered the heater well. Referring to FIG. 3, another type of array is shown, where there are three rows of wells 12. The rows of wells 12 are shown as being offset, as it is believed that this promotes a more uniform distribution of heat to fluids being produced in the lower row of wells 12. It will be understood that the array of wells 12 may take various forms with respect to the number of wells, their relative position, etc. Furthermore, while producer wells are generally at the bottom of the array to take advantage of gravity as the hydrocarbons flow downward, this may not be the case in all circumstances.

Referring to FIG. 1, once the array of wells 12 is drilled and the producer and heater wells 12 are identified, a heater string 14 is inserted into one or more heater wells 12. Heater string 14 has a heating element 16 and a flow passage 18 that allows fluid to be transported from a fluid input 20 to injection ports 22. Heating element 16 is preferably a resistive, or electrical heater that generates heat as electrical current is passed through it, and may be a radiative heating element. Heating element 16 may be a typical heating cable as is known in the art. This arrangement allows conductive or convective heat, which may be considered "dry" heat, to be uniformly applied to formation 10 and also allows heated fluids to be injected into heater wells 12. In other words, the heat generated by heating element 16 is transferred by conduction to the wellbore. Within the wellbore, the heat may then be transferred to the formation by conduction or convection through the substances, such as gas or fluids, in the wellbore. As will be explained below, these heating strategies are applied consecutively in order to produce hydrocarbons from a well. However, not all wells 12 that are heated will have similar heater strings 14. While at least one heater string 14 as described below will be used in the method, other heaters, such as tubing strings that are only used to inject heated fluids, or other heating elements (i.e. tubing, cables, combustion burners, etc.)

that are only used to apply heat.

Heating element 16 may take various forms as will be recognized. In one example, referring to FIG. 2, heating element 16 is depicted as being part of a concentric tubing string, where heating element 16 is disposed within an outer tubing string 24. Heating element 16 may be a cable or another coiled tubing string of a smaller diameter that acts as an electrical heating element that is heated by passing an electrical current along its length. In one aspect, it may be possible for the power supply to be direct current and the heating element 16 to be electrically connected to outer tubing string 24 at the end of the heating section to allow a return path for the current, and is otherwise electrically isolated. Another aspect would have a second electrically insulated conductor connected to the distal end of the heating element or heating cable to provide a return path for the current to the power supply. In some circumstances, it may be desirable to apply more, less, or no heat at certain points or lengths within the heater well 12. The amount and location of heat along heating element 16 may be controlled by providing different materials along its length or by adjusting the power supply. As a further alternative, the outer tubing string 24 may act as heating element 16. The circuit may be completed using various known designs. Other suitable variations to the options described above will be recognized by those skilled in the art. In one example, the heating element may be three electrically insulated conductors electrically connected at the distal end and supplied with alternating current to form a three-phase heater. A plurality of heaters may be installed inside the outer tubing string 24. In another example, heating element 16 may be a gas-powered heater instead of electrical. Heating element 16 may be an elongated heater, or may radiate heat along a defined length, to apply the heat more evenly along the wells 12, or at targeted locations along wells 12.

In addition to heating element 16, heater string 14 also has injection ports 22 and a fluid flow path 18. As depicted, fluid flow path 18 is defined by an inner surface of outer tubing string 24. Referring to FIG. 1, fluid flow path 18 conducts fluid from fluid input 20 to injection ports 22. Preferably, as shown in FIG. 1, there are multiple injection ports 22 spaced along the length of heater string 14. This results in a more even distribution of heat. It will be understood, of course, that injection ports 22 need not be evenly spaced, and that heated fluid may be kept from certain parts of formation 10, depending on the specific makeup of formation 10 and the strategy being employed by the well producer. As depicted, heated fluids are injected from a heated fluid source 26 into heater string 14, where fluids are heated prior to being injected. Fluids may be heated by a heater that is part of fluid source 26, or separate, such as a line heater. It will be understood that other heating strategies may also be used. For example, the fluids may be heated in situ by heating element 16 as they pass along heater string 14 prior to being injected to heat the fluids to the desired temperature and pressure when they encounter the formation. This may or may not involve vaporizing the fluids as they pass along heater string 14. The fluids may also be vaporized as they exit heater string 14 for example, through an expansion nozzle. As can be seen, there are a variety of approaches that may be used to ensure the fluids are injected into the formation at a desired temperature and pressure. The fluids being heated and injected may also be solvents that are heated to a gas phase prior to being injected. One example of a suitable solvent is butane, which converts to a gas at about 50° C. and has an adequate phase envelope of temperature/pressure for the target temperature envisioned. Other C2-C7 hydrocarbons or combination of hydrocarbons or manufactured hydrocarbons or alcohol compounds may also be used. In some applications, light hydrocarbons or manufactured hydrocarbon compounds such as dimethyl ether that may be a gas at atmospheric conditions may be used. These solvents are able to mix with the hydrocarbons being produced to provide a better heat transfer and reduce the viscosity of the hydrocarbons to allow them to flow more freely. While injecting steam into a reservoir decreases the reservoirs relative permeability to oil, injecting solvent does not affect the reservoirs relative permeability to oil. To monitor the process and the formation conditions, temperature and pressure monitoring cables (not shown), such as thermocouple or fiber optic cables, may be introduced in the wellbore using techniques that are known in the art.

Figure 2:
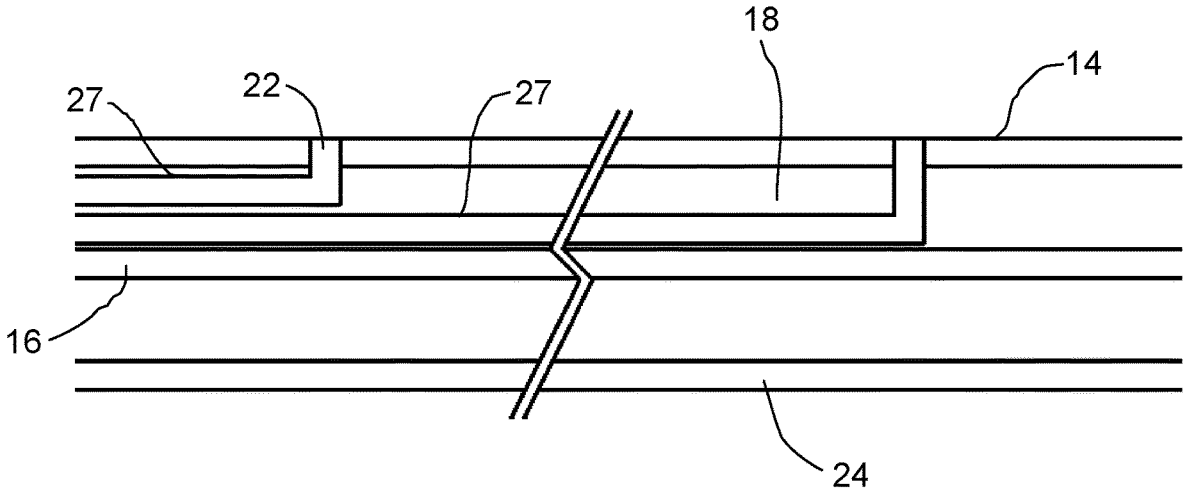
FIG. 2 is a detailed side elevation view in section of a portion of a heater string.

Generally, the amount of fluid flowing through different ports 22 along heater string 14 will vary depending on their position. Accordingly, the sizes of ports 22 may be modified to achieve a desired distribution of solvent injected into formation 10 and preferably an equal distribution. It will also be understood, however, that solvent travelling to the end of heater string 14 will have a longer period of time to be heated, and therefore may have more heat. The desired distribution may be modified to account for this as well, depending on the preferences of the user and the characteristics of formation 10. Referring to FIG. 2, in order to achieve a desired distribution and retention time within heater string 14, individual injection tubing strings 27 may be connected to each port 22, such that solvent may be injected at a desired volume and pressure. For example, the pressure may be higher in an injection tubing 27 connected to a port at the toe of heater string 14 compared to tubing connected to a port closer to the heel, such that the velocity of the solvent is greater when travelling to the toe, allowing for a more equal heating of solvent. In addition, the size of the injection tubing 27 may also vary, such that, for greater pressures, an equivalent amount of solvent is injected. Injection tubing 27 may be capillary tubing, or larger tubing depending on the requirements of the system. Using larger injection tubing 27 has the benefit of slowing the injection fluid velocity to increase retention time, while capillary tubing increases the surface area to volume ratio and requires less space.

In addition to the design principles described above, other modifications will be apparent to those skilled in the art. For example, individual injection tubing strings 27 may be connected to multiple ports 22. Based on this, the desired distribution and injection characteristics may be achieved using known fluid dynamic principles. Using these approaches, a desired solvent and heat distribution may be achieved.

The basic procedure is as follows. Referring to FIG. 1, heating element 16 is activated to heat formation 10 in heater well 12*a* immediately adjacent to the section of heating element 16 producing heat. This may be referred to as the preheating stage, and may involve applying heat to more wells than heater well 12*a*. For example, while not shown, a heating element may also be inserted into production well 12*b*. This heating element will generally not include the injection ports, as it will be removed after the preheat stage is complete and before fluid is injected, such that a tubing string with ports is unnecessary. Once formation 10 is heated sufficiently that some hydrocarbons have sufficient viscosity to be produced. These hydrocarbons will be produced from production well 12*b* that is below heater well 12*a* using production tubing 25, although in some cases hydrocarbons may also be produced from heater well 12*a*. As a result of this mobility of the hydrocarbons, some voidage 23 is created in formation 10. Voidage 23 is created as the hydrocarbons leave formation 10. Most formations are porous and the hydrocarbons are held within the pores of the formation. As the hydrocarbons are heated and flow out of the formation, this results in empty space in the pores of the formation, referred to as voidage. The ability to produce fluids indicates that the preheating phase is completed and the second phase can then be applied to formation 10, which is to produce sufficient fluids and create sufficient voidage for the next step.

Once voidage 23 is created to the desired degree, the next step is to inject heated fluids into well 12. The injected fluids are preferably solvents that are liquids at surface prior to heating and injections and are then heated to the gaseous phase, which exits heater string 14 via ports 22 and is injected into the voidage in the formation created by the hydrocarbons produced as a result of heating element 16. Production of hydrocarbons from production well 12 may then proceed according to known methods, for example by installing an electric submersible pump.

Figure 4:
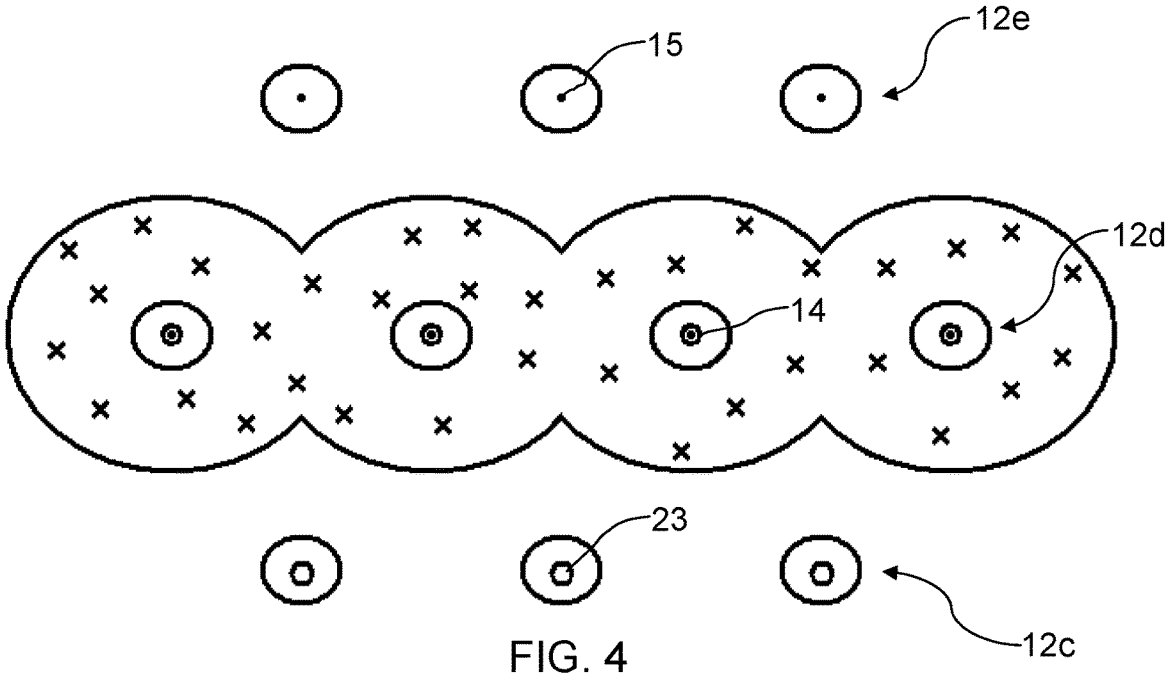
FIG. 4 is an end elevation view of a horizontal wellbore pattern in a formation being produced.

Referring to FIGS. 3 and 4, the method described above may also be applied to other arrays of wells. In this example, there is an array of wells made up of three general rows of wells—a bottom row 12*c*, a middle row 12*d* and an upper row 12*e*. An example of how hydrocarbons may be produced from this arrangement will now be described.

Referring to FIG. 3, a first step may involve heating rows 12*c* and 12*d* with electric heating elements to produce voidage 23 around the heated wells. As shown, heating elements 14 in row 12*d* are similar to those described with respect to FIGS. 1 and 2 and are capable of conductive heating as well as injecting heated fluids, while heating elements 15 in row 12*e* may be conductive heating elements only. In FIG. 4, once a certain target temperature and corresponding oil viscosity in the formation has been achieved, heating elements 15 may be moved from row 12*c* to 12*e* and production tubing 25 may be inserted into row 12*c*. Alternatively, heating elements 15 may be replaced with injection-type heaters, or combination heaters 14.

Figure 5:
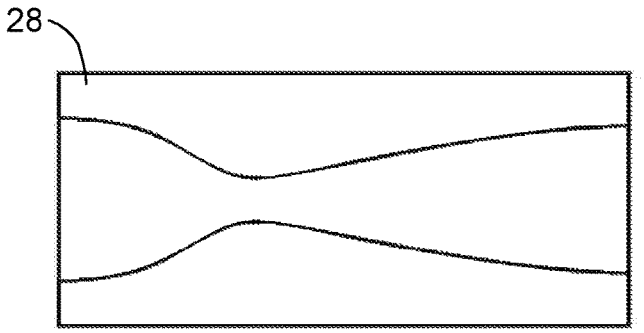
FIG. 5 is a side elevation view in section of an expansion nozzle.

An example of a possible series of steps will now be described. Referring to FIG. 1, in a first phase, a wellbore 12*a* is pre-heated using a heater tube 14. In the next phase, a limited amount of production occurs from wellbore 12*b*. This creates voidage 23 that improves the production index (PI) and helps to repair skin damage that may have been caused during drilling. In the third phase, solvent injection through heater tube 14 begins. As shown, heater tube 14 preferably has multiple injection port 22 and vapourized solvent or solvents, for example, butane, is injected into wellbore 12 through these ports. Providing multiple injection ports 22 allows for a more effective gravity drainage process by providing a more effective or uniform solvent distribution. As mentioned above the solvent may be vapourized by passing through heater tube 14, which is heated by heating element 16 or it may be injected into heater tube 14 as a vapour. This may be due to atmospheric conditions or heating at surface, in which case heater tube 14 merely maintains the solvent in the vapour phase as it is injected and heats the solvent to the desired temperature. Alternatively, the solvent may be vapourized as it passes through an expansion nozzle at each injection port 22. An example of an expansion nozzle is shown in FIG. 5, and identified by reference numeral 28. Expansion nozzles 28 are well known, and it will be understood that the actual profile of expansion nozzles 28 may vary. If present, these expansion nozzles 28 are attached at injection ports 22 along heater tube 14. Once the hydrocarbons in the formation become mobile, production may begin as described above.

In another phase, a carrier gas, such as $CO_2$, may be injected along with the selected solvent to reduce the solvent requirements, and associated cost, as well as for voidage replacement/maintenance. This may be used to promote a lower solvent to oil ratio, resulting in better economics for the well. The carrier gas may be injected from a separate source of gas such that the carrier gas and solvent mix in the heater tuber 14, or may be mixed with the solvent prior to injection. A preferred method may be to use the carrier gas as a displacement gas whereby the solvent is injected through the ports in pure form followed by the displacement gas separately to avoid gas mixing and to move or displace the solvent further into the reservoir. In other embodiments, the carrier gas may be a miscible gas such as CO, $CO_2$, or an inert gas such as nitrogen, and may be injected in a separate step from the injection of the solvent. After injection of the solvent, the carrier gas may injected separately for the purpose of transporting the solvent to greater distances from the injection well, and to reduce the volume of solvent required and to increase the region of influence of the solvent and heat delivered around the well pair.

In another phase, maintenance heaters may be used to service and improve the production from well 12. Existing heater tubes 14 or heating elements 16 may be used as maintenance heaters, or new heaters may be inserted instead. In one example, referring to FIG. 4, heaters may be removed from lower heater wells 12*c* and inserted into a new set of wells (not shown) drilled above upper wells 12*e*.

Figure 7:
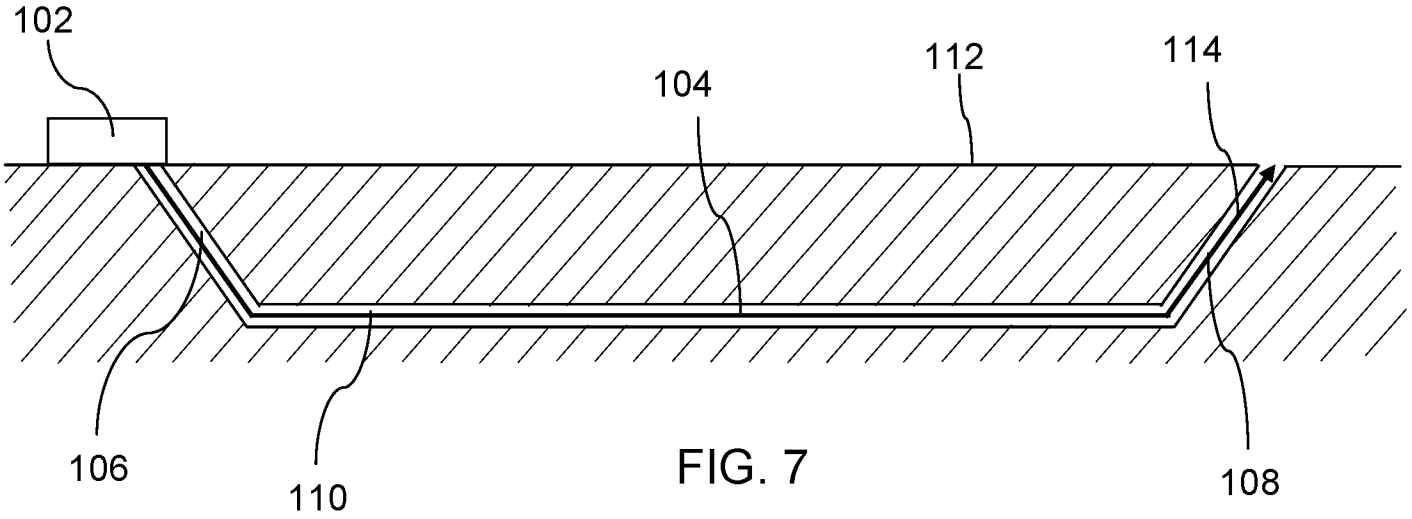
FIG. 7 is a side elevation view of a supplemental heater well borehole with a drill string in the borehole.
Figure 8:
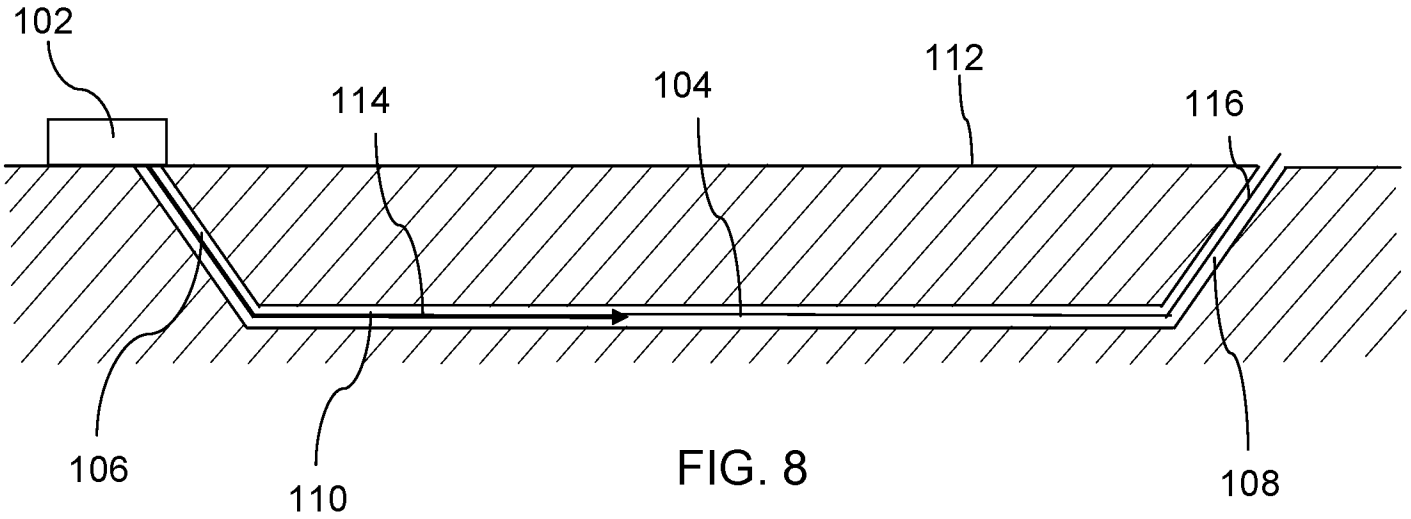
FIG. 8 is a side elevation view of a supplemental heater well borehole with a supplemental heater being pulled through the well.
Figure 10:
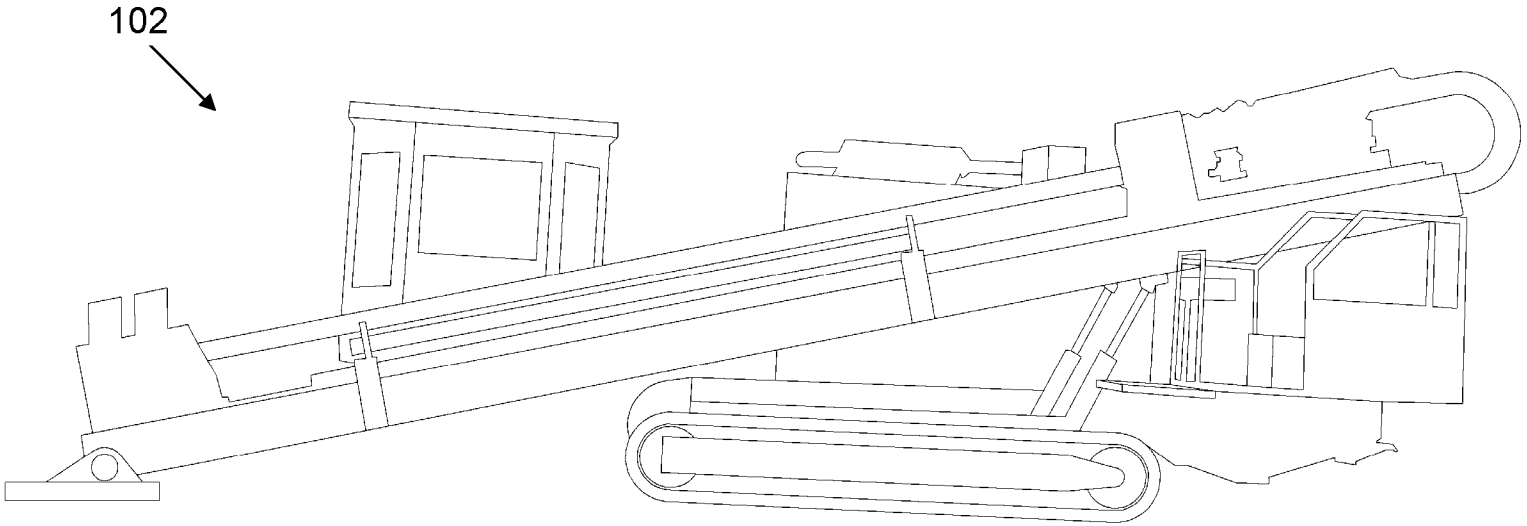
FIG. 10 is a side elevation view of a directional drilling rig.

The spacing of the heater wells and production wells may be determined by the desired region of influence around the well pair or by the economics of the well operation. It may be necessary to provide supplementary heater wells 100 to increase production. These wells may be drilled with traditional methods, or may be drilled using a method of directional drilling that is typically used for subterranean river or road crossings, which are generally shallow. For example, drilling rig 102 may deploy a subterranean rotary positive displacement motor that rotates a drill bit to create a drill hole in the earth. One example of such a directional drilling rig 102 is shown in FIG. 10. When supplementary heater wells 100 are required, the first step is to identify locations within the underground formation that require additional heating, such as areas that are not heated or are insufficiently heated by the heating element of the heater string 14. These may be additional locations within the reservoir that may remain outside the region that is heated by the first or second or third group of wells. Referring to FIG. 7, one or more heater wells 100 is then provided in one or more identified locations by drilling a heater well borehole 104 in the one or more identified locations using a drilling rig that has a drill string 114, the heater well borehole 104 having an entry portion 106 drilled at an angle of less than 90 degrees to a ground surface 112, an exit portion 108 extending to the ground surface 112, and a horizontal portion 110 connecting entry portion 106 and exit portion 108. Horizontal portion 110 preferably extends through the oil bearing formation for a predetermined distance before being directed back to the surface through exit portion 108 at a planned location. When the drill string emerges at the far end of heater well borehole 104, at ground surface 112, an elongate supplemental heater 116 is attached to the end of the drill string at exit portion 108. Supplemental heater 116 may be a heating cable or a heating element. Referring to FIG. 8, once supplemental heater 116 is attached to drill string 114, the drill string 114 is withdrawn from heater well borehole 104 by drilling rig 102, pulling supplemental heater 116 through heater well borehole 104 such that elongate supplemental heater 116 is disposed within at least a portion of heater well borehole 104. Elongate supplemental heater 116 can then be detached from drill string 114, and remains in heater well borehole 104, extending along the length of heater well borehole 104. Heater well borehole 104 is then filled with a filling material such as cement to surround the supplemental heater 116. The filling material may displace the drilling mud from the drill hole and completely fill the drill hole. In order to increase the thermal conductivity of the cement, additive materials such as metal filings may be added to the cement. The elongate supplemental heater 116 may be an electric heating element that is connected at a first end to a positive side of a power supply and a second end to a negative side of the power supply, and where multiple heater wells are provided, the supplemental heaters of each of the heater wells may be connected to a common power supply.

Figure 9:
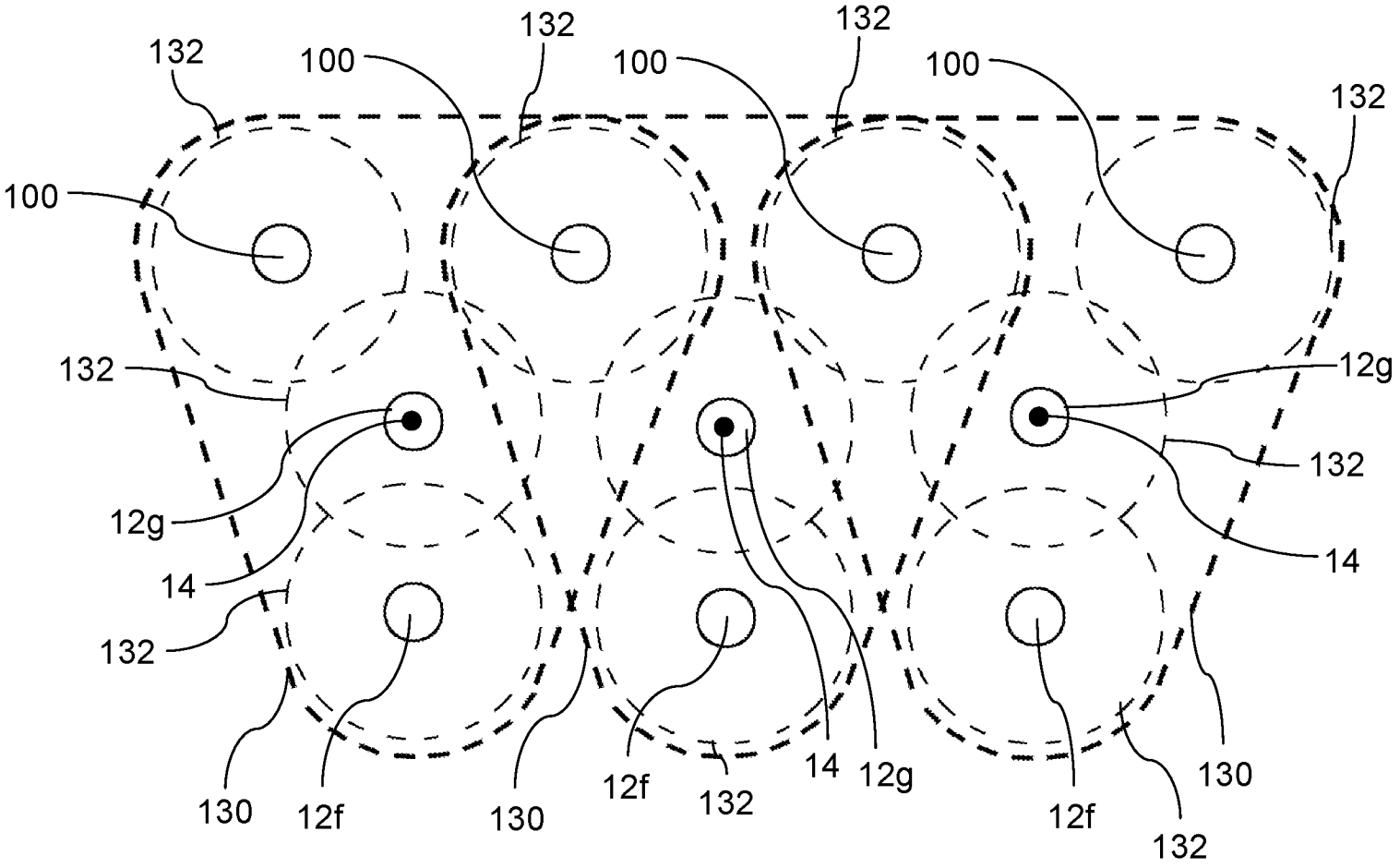
FIG. 9 is an end elevation view of an array of production and heater wells.

Referring to FIG. 9, an example of a well configuration having production wells 12*f*, heater wells 12*g*, and supplemental heater wells 100 is shown. In this example, production wells 12*f* are drilled at the lowest point in a production region 130. Heater wells 12*g* are spaced vertically above the production wells 12*f*. Supplemental heater wells 100 are then spaced vertically above the heater wells 12*g* and offset in order to increase the production from the production region 130. It will be understood that the heater wells 12*g* and supplemental heater wells 100 are spaced such that the region of influence 132 of each of the wells intersects the region of influence of the adjacent wells. This connection between the regions of influence 132 allows the amount of production fluids mobilized to be increased, and for the production fluids to flow downward into production wells 12*f*. It will be understood that the number, spacing, and arrangement of the wells need not be similar to what is shown, and may vary depending on the environment and economics of any given production site, as will be understood by those skilled in the art.

Figure 6:
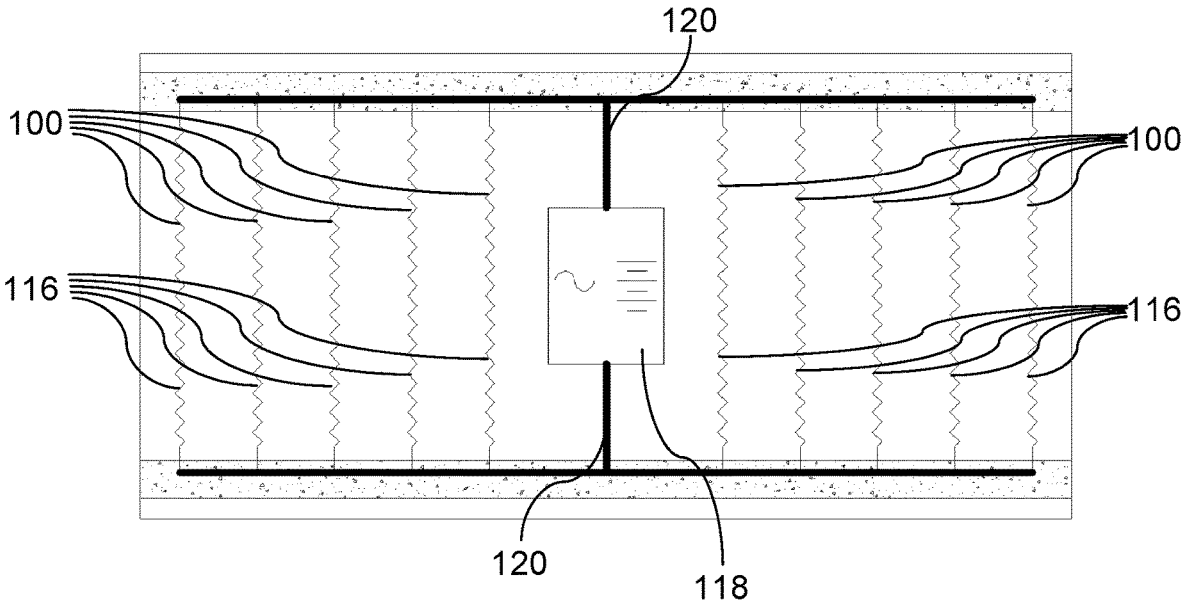
FIG. 6 is a top plan view of a series of supplemental heater wells.

As shown in FIG. 6, the supplemental heater wells 100 may be grouped in a heater array having multiple resistive heater elements 116 connected to an AC or DC power supply 118 by two electrical buses 120, each electrical bus 120 including one or a multiple of conductors. As will be understood by those skilled in the art, the arrangement and elements of this heater array may take various forms. In one example of the heater array, the heater elements may include load balancing circuitry at one end of the heater elements. In another example of the heater array, the heater elements may include load balancing circuitry at the power supply. In another example, the heater elements may include load balancing circuitry at one end of the element and at the power supply. These variations of the heater array may be combinable such that the heater array includes heater elements with load balancing circuitry at one end of the heater elements and at the power supply. In addition, the array assembly power supply may contain load shedding circuitry and logic to limit input power grid peak demands.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. The scope of the claims should not be limited by the preferred embodiments set forth in the examples, but should be given the broadest interpretation consistent with the description as a whole.

What is claimed is:

1. A method of producing hydrocarbons from an underground formation having an array of horizontal wells, comprising the steps of:

identifying one or more producer well sections in the array of horizontal wells and one or more heater well sections in a well adjacent to the producer well sections;

inserting one or more heater strings into at least one heater well section of the one or more heater well sections, each heater string comprising a heating element and a flow passage for transporting fluid to a series of injection ports spaced along a length of the heater string;

in a pre-heating phase, before any fluid is injected into the at least one heater well section:

activating the heating element of the one or more heater strings to heat the formation sufficient to mobilize hydrocarbons in the formation immediately adjacent to the at least one heater well section; and creating voidage in the formation around the one or more heater strings by producing at least some of the mobilized hydrocarbons from the at least one heater well section using a pump; and in a production phase:

heating and injecting a solvent into the at least one heater well section in a gaseous phase through at least one injection port of the one or more heater strings such that the solvent is injected into the voidage created in the pre-heating phase; and producing hydrocarbons from at least one of the one or more producer well sections;

wherein, in the pre-heating phase and the production phase, pressures in the one or more heater well sections are maintained at between 100 and 800 kPa.

2. The method of claim 1, wherein the solvent is injected into the at least one heater well section prior to hydrocarbons being produced from the at least one of the one or more producer well sections.

3. The method of claim 1, wherein the series of injection ports are scaled to distribute solvent in a desired distribution at discrete locations spaced along a length of the one or more heater strings.

4. The method of claim 3, wherein the series of injection ports are connected to separate injection tubes.

5. The method of claim 4, further comprising the step of independently controlling the injection through each injection port.

6. The method of claim 5, further comprising the step of selecting an injection rate through each injection port to achieve a desired distribution of solvent.

7. The method of claim 1, wherein the heating element is a resistive heater.

8. The method of claim 1, wherein the solvent is injected into the one or more heater strings as a liquid and is vapourized prior to injection into the voidage.

9. The method of claim 1, wherein the solvent is injected into the one or more heater strings in a gaseous phase.

10. The method of claim 1, wherein the solvent comprises a light hydrocarbon or a manufactured hydrocarbon compound.

11. The method of claim 1, wherein the solvent comprises dimethyl ether.

12. The method of claim 1, further comprising the step of injecting a carrier gas after injecting the solvent to transport the solvent into the formation and promote the production of hydrocarbons, the carrier gas comprising a carbon-containing gas, an inert gas, or a carbon-containing gas and an inert gas.

13. The method of claim 1, further comprising the steps of:

identifying locations within the underground formation that require additional heating; and providing one or more heater wells in one or more identified locations, wherein providing a heater well comprises the steps of:

drilling a heater well borehole in the one or more identified locations using a drill string, the heater well borehole comprising an entry portion drilled at an angle of less than 90 degrees to a ground surface, an exit portion extending to the ground surface, and a horizontal portion connecting the entry portion and the exit portion;

attaching an elongate supplemental heater to the drill string at the exit portion;

withdrawing the drill string from the heater well borehole such that the elongate supplemental heater is disposed within at least a portion of the heater well borehole;

detaching the elongate supplemental heater from the drill string; and filling the heater well borehole with a filling material that surrounds the supplemental heater.

14. The method of claim 13, wherein the filling material comprises cement.

15. The method of claim 14, wherein the cement comprises an additive that increases the thermal conductivity of the cement.

16. The method of claim 15, wherein the additive comprises metal filings.

17. The method of claim 13, wherein the elongate supplemental heater comprises an electric heating element that is connected at a first end to a positive side of a power supply and a second end to a negative side of the power supply.

18. The method of claim 17, wherein providing one or more heater wells comprises providing a plurality of heater wells, the supplemental heaters of each of the heater wells being connected to a common power supply.

19. A method of producing hydrocarbons from an underground formation having an array of horizontal wells spaced vertically and laterally in the underground formation, the method comprising the steps of:

identifying an upper group of well sections comprising a plurality of laterally-spaced horizontal wells and a lower group of laterally-spaced well sections comprising a plurality of laterally-spaced horizontal wells, the upper group of well sections being positioned above the lower group of well sections;

inserting heater strings into the upper and lower groups of well sections, each heater string in the upper group of well sections comprising a heating element and a flow passage for communicating fluid from a fluid input to at least one injection port and each heater string in the lower group of well sections comprising at least a heating element;

before any fluid is injected into the upper group of well sections, creating voidage in the formation immediately adjacent to the upper and lower groups of well sections by applying sufficient heat to mobilize a portion of the hydrocarbons and producing the mobilized hydrocarbons from at least the upper group of well sections using a pump; and once voidage is created, injecting heated gaseous solvent into the voidage of the upper group of well sections while maintaining pressures in the one or more heater well sections at between 100 and 800 kPa; and producing hydrocarbons from the lower group of well sections.

20. The method of claim 19, further comprising the steps of:

identifying a third group of well sections above the upper group of well sections; and once the voidage is created, moving the heating elements from the lower groups of well sections to the third group of well sections.

21. The method of claim 19, wherein the solvent is injected into the formation prior to hydrocarbons being produced from the upper or lower group of well sections.

22. The method of claim 19, wherein each heater string comprises a series of injection ports at discrete locations spaced along a length of the heater string.

23. The method of claim 19, wherein the heating elements in the lower group of well sections comprise resistive heaters.

24. The method of claim 19, wherein the solvent is injected into the flow passage of the heater strings as a liquid and is vapourized prior to injection into the voidage.

25. The method of claim 19, wherein the at least one injection port comprises a plurality of injection ports and the flow passage comprises separate injection tubes connected to each of the plurality of injection ports.

26. The method of claim 25, further comprising the step of independently controlling the solvent injection through each injection tube and injection port.

27. The method of claim 26, further comprising the step of selecting an injection rate through each injection tube and injection port to achieve a desired distribution of solvent.

28. The method of claim 19, wherein the solvent comprises a light hydrocarbon or a manufactured hydrocarbon compound.

29. The method of claim 19, wherein the solvent comprises dimethyl ether.

30. The method of claim 19, further comprising the step of injecting a carrier gas after injecting the solvent to transport the solvent into the formation and promote the production of hydrocarbons, the carrier gas comprising a carbon-containing gas, an inert gas, or a combination of a carbon-containing gas and an inert gas.

31. The method of claim 19, further comprising the steps of:

identifying locations within the underground formation that require additional heating; and providing one or more heater wells in one or more of the identified locations, wherein providing a heater well comprises the steps of:

drilling a heater well borehole in the one or more identified locations using a drill string, the heater well borehole comprising an entry portion drilled at an angle of less than 90 degrees to a ground surface, an exit portion extending to the ground surface, and a horizontal portion connecting the entry portion and the exit portion;

attaching an elongate supplemental heater to the drill string at the exit portion;

withdrawing the drill string from the heater well borehole such that the elongate supplemental heater is disposed within at least a portion of the heater well borehole;

detaching the elongate supplemental heater from the drill string; and filling the heater well borehole with a filling material that surrounds the supplemental heater.

32. The method of claim 31, wherein the filling material comprises cement.

33. The method of claim 32, wherein the cement further comprises an additive that increases the thermal conductivity of the cement.

34. The method of claim 33, wherein the additive comprises metal filings.

35. The method of claim 31, wherein the elongate supplemental heater comprises an electric heating element that is connected at a first end to a positive side of a power supply and a second end to a negative side of the power supply.

36. The method of claim 35, wherein providing one or more heater wells comprises providing a plurality of heater wells, the supplemental heaters of each of the heater wells being connected to a common power supply.

* * * * *